US005103895A

United States Patent [19]

Furuya et al.

[11] Patent Number: 5,103,895

[45] Date of Patent: Apr. 14, 1992

[54] METHOD AND APPARATUS OF CONTINUOUSLY CASTING A METAL SHEET

[75] Inventors: Takashi Furuya; Hidemaro Takeuchi; Akio Kasama, all of Hikari; Yasuo Itoh, Kitakyushu; Motoya Fujii, Hikari; Hideki Oka, Hikari; Shogo Matsumura, Hikari; Kunimasa Sasaki; Keiichi Yamamoto, both of Hiroshima, all of Japan

[73] Assignees: Nippon Steel Corporation; Mitsubishi Jukogyo Kabushiki Kaisha, both of Tokyo, Japan

[21] Appl. No.: 554,190

[22] Filed: Jul. 17, 1990

[30] Foreign Application Priority Data

| | | | |
|---|---|---|---|
| Jul. 20, 1989 | [JP] | Japan | 1-84510[U] |
| Aug. 1, 1989 | [JP] | Japan | 1-201107 |
| Aug. 17, 1989 | [JP] | Japan | 1-210653 |

[51] Int. Cl.[5] ..... B22D 11/00

[52] U.S. Cl. ..... 164/475; 164/480

[58] Field of Search ..... 164/475, 415, 428, 480, 164/423, 463

[56] References Cited

U.S. PATENT DOCUMENTS 4,987,949 1/1991 Sakaguchi et al. ..... 164/428

FOREIGN PATENT DOCUMENTS

| | | |
|---|---|---|
| 0124684 | 11/1984 | European Pat. Off. . |
| 0309247 | 3/1989 | European Pat. Off. . |
| 58-157250 | 9/1983 | Japan . |
| 60-184449 | 9/1985 | Japan . |
| 62-130749 | 6/1987 | Japan . |
| 01-83340 | 3/1989 | Japan . |
| 1-83342 | 3/1989 | Japan . |

OTHER PUBLICATIONS

Patent Abstracts of Japan, vol. 7, No. 149, (M-225) [1294] Jun., 1983.

Patent Abstracts of Japan, vol. 5, No. 123 (M-82) [795] Aug., 1981.

European Search Report EP 90 30 7958.

*Primary Examiner*—Kuang Y. Lin

*Attorney, Agent, or Firm*—Kenyon & Kenyon

[57] ABSTRACT

Molten metal is supplied to a pouring basin formed between cooling members, such as movable cooling drums. A closed space is formed at a meniscus area whereat any one of the cooling members starts to come into contact with the molten metal, and a soluble gas or a mixture of soluble and insoluble gases is supplied to and filled in the closed space, thereby covering the meniscus area with the gas or the mixture. This arrangement enables a continuous casting of a thin metal sheet without surface cracks and having excellent surface characteristics.

18 Claims, 10 Drawing Sheets

METHOD AND APPARATUS OF CONTINUOUSLY CASTING A METAL SHEET

BACKGROUND OF THE INVENTION

1. Field of the Invention

The present invention relates to a method and apparatus of continuously casting a metal sheet by using cooling members such as cooling drums and belts that are movable and act as a part of a mold, and more particularly, to a continuous casting method and apparatus that produces a metal sheet having a high quality and superior surface characteristics.

2. Description of the Related Art

A reduction in manufacturing costs and a creation of new materials are particularly required in the field of continuous metal casting, and accordingly, there is a strong demand for the ability to cast a metal sheet one to ten millimeters in thickness that is nearly equal to the thickness of a final product, by using, for example, a drum-type continuous casting machine incorporating a cooling mechanism. This sort of technique is disclosed in Japanese Unexamined Utility Model Publication 58-157250, Japanese Unexamined Patent Publication 60-184449, Japanese Unexamined Patent Publication 1-83340, Japanese Unexamined Patent Publication 1-83342 and Japanese Unexamined Patent Publication 62-130749, etc.

The object of Japanese Unexamined Patent Publication 60-184449 Japanese Unexamined Patent Publication 1-83340, Japanese Unexamined Patent Publication 1-83342 is to equalize the solidified thickness of a cast metal sheet and prevent surface cracks, by providing irregularities of cooling on the surface of a cooling drum. Japanese Unexamined Patent Publication 62-130749 prevents an inclusion of oxides in a cast metal sheet, and a deterioration of the surface quality of the cast metal sheet, by casting molten metal in an inert gas atmosphere.

According to tests carried out by the inventors of the present invention, however, these conventional techniques do not substantially provide sheets having a good and stable surface quality. For example, Japanese Unexamined Patent Publication 60-184449 forms irregularities, i.e., recesses and protrusions each about four micrometers or more in size on the surface of a drum, but this disclosure does not pay careful attention to the relationship between the surface irregularities and the thickness of a cast metal sheet, and thus the problems of surface cracks and a surface quality deterioration may arise. Namely, when the cast metal sheet is thin, and the irregularities formed on the surface of the cooling drum are too large compared with the thickness of the sheet, thermal stress may be concentrated around the irregularities to thereby produce small cracks that remain as surface defects of the sheet. On the other hand, when the cast metal sheet is thick and the irregularities are too small compared with the thickness of the sheet, the solidification stress is not sufficiently distributed and therefore, large surface cracks are produced.

Japanese Unexamined Patent Publication 62-130749 is also not satisfactory because the rotary mold thereof does not have surface irregularities, and therefore, cooling may increase an amount of thermal contraction to cause a local stress concentration, to thereby produce surface cracks.

SUMMARY OF THE INVENTION

To solve the problems of the conventional techniques, a main object of the present invention is to provide a means for stably casting a metal sheet having no surface cracks, and providing a cold rolled product having no surface defects.

To accomplish this object, a method and apparatus according to the present invention supplies a gas (a soluble gas, or a mixture of soluble gas and insoluble gas that does not dissolve in molten metal; a mixing ratio thereof being adjusted) to a meniscus area whereat molten metal starts to come into contact with a cooling member.

The present invention also adjusts the temperature of a casting atmosphere, to thereby further improve the effect of the present invention.

The present invention further maintains a complete inert atmosphere above a pouring basin of molten metal, to prevent a deterioration of the surface quality.

Generally, each rotary cooling drum of a continuous casting machine is made of copper, incorporates a cooling mechanism, and has a nickel-plated surface. Since a molten metal to be cast, e.g., molten austenite stainless steel, has a temperature of about 1500 degrees in centigrade, the drum must have a cooling mechanism that can withstand such a temperature. Nevertheless, when the casting machine casts a thin metal sheet one to ten millimeters in thickness, the cooling function, if excessive, will easily produce surface cracks on the sheet. Therefore, to prevent these surface cracks, and to control the cooling performance of the drum, dimples are formed on the surface of the drum.

According to the present invention, each cooling member, such as a drum or a belt, has many circular or elliptic dimples on the surface thereof. these dimples are exposed to the outside air and then enter a pouring basin defined between the cooling members, to come into contact with molten metal collected in the pouring basin.

Namely, the dimples of the cooling members contain air, and the molten metal cooled by the cooling members emits a gas dissolved therein and the emitted gas is caught by the dimples in a meniscus area. Therefore, as the cooling members move, the gas is locked between the dimples and the molten metal.

The locked air and gas may form scale on the surface of a solidified shell of the molten metal, thereby deteriorating the surface quality of a cast metal sheet.

If the dimples capture an inert gas instead of the air, the scale is not be formed on the surface of a solidified shell, but the inert gas may rapidly expand when heated by the molten metal or by the solidified shell, and if the inert gas is an insoluble gas such as an argon (Ar) gas that does not dissolve in the molten metal, the gas may form dents on the surface of the solidified shell at locations corresponding to the dimples of the cooling members. The dents on the solidified shell cause the solidified shell to freely slide on the cooling members when the solidified shell is contracted, and as a result, thermal stress is concentrated at weak locations of the solidified shell, to thereby form large surface cracks in the solidified shell.

The inventors clarified these problems, and thus have completed this invention.

According to the present invention, a soluble gas such as a nitrogen ($N_2$) gas is supplied to a meniscus area whereat the surface of each cooling member having dimples starts to come into contact with the molten metal. The supplied gas purges air and a gas emitted from the molten metal away from each dimple and occupies the dimple, and the soluble gas thus caught in the respective dimples is absorbed by the molten metal during casting, and therefore, the solidified shell protrudes into the respective dimples.

Due to the protrusions of the solidified shell in the dimples of the cooling member, the solidified shell does not freely slide on the cooling member when the solidified shell is contracted, and the gas caught in each dimple forms a gas cap over each protrusion of the solidified shell, thereby providing a slow cooling effect on the protrusion.

Since the slowly cooled protrusions corresponding to the dimples on the cooling member are distributed over a cast metal sheet, the metal sheet is continuously and stably cast.

Peripheral areas around the slowly cooled protrusions on the surface of the cast metal sheet are rapidly cooled by direct contact with the cooling member, so that the peripheral areas may have higher rigidity, and accordingly, tensile stress caused by a contraction of the solidified shell is distributed to a plurality of the separate protrusions each having a smaller rigidity, to thereby prevent an-occurrence of cracks in the cast metal sheet during solidification.

Each protrusion of the solidified shell into a corresponding dimple of the cooling member prevents an excessive amount of gas from remaining in the dimple, to thereby form a uniform gas cap over the protrusion. This ensure the casting of a smooth metal sheet.

An atmosphere over the pouring basin is not particularly limited, as long as the meniscus area is sufficiently protected by a non-oxidizing soluble gas. An atmosphere adjusting space for the pouring basin and an atmosphere adjusting space for the meniscus area may be separately provided, and gases supplied to the spaces may be separately selected according to requirement.

To protect the surface of the pouring basin from oxidation, a non-oxidizing gas such as argon (Ar) and nitrogen ($N_2$) may be supplied to the pouring basin, and if the gas deteriorates the quality of molten metal by dissolving in the molten metal, an insoluble gas such as argon (Ar) may be supplied to the pouring basin. Even if the atmosphere over the pouring basin is air, oxides formed on the surface of molten metal will not be involved in a cast metal sheet if the meniscus area is sufficiently shielded by a gas.

According to one important aspect of the present invention, a mixture of soluble gas and insoluble gas is supplied to the meniscus area.

As described before, when a soluble gas is supplied to the meniscus area, slowly cooled protrusions are formed on the surface of a cast metal sheet, and the protrusions prevent an occurrence of cracks in the cast metal sheet.

According to tests carried out by the inventors, however, excessively large protrusions formed on the surface of the cast metal sheet may produce an uneven brightness on the sheet, after the sheet is cold-rolled. This problem may be solved by polishing the cold-rolled sheet. If the sheet is not polished, however, it is necessary to adjust the size and amount of the protrusions to an allowable range. The inventors found, as described before, that dimples containing a soluble gas form protrusions on a solidified shell, and dimples containing an insoluble gas form dents on the solidified shell, and through various tests, the inventors found that supplying a mixture of insoluble and soluble gases to the dimples and adjusting a mixing ratio of the gases can adjust the size and amount of the protrusions. Namely, the present invention adjusts a mixing ratio of gases to be sealed in the dimples, thereby forming optimum patterns transferred from the dimples to a cast metal sheet. This method is appropriate for practical manufacturing.

According to the present invention, the gas supplied to the dimples is preheated to a predetermined temperature or higher, to reduce the influence of an expansion of the gas sealed in the dimples.

DESCRIPTION OF THE PREFERRED EMBODIMENTS

Preferred embodiments of the present invention will be explained with reference to the drawings.

Figure 1:
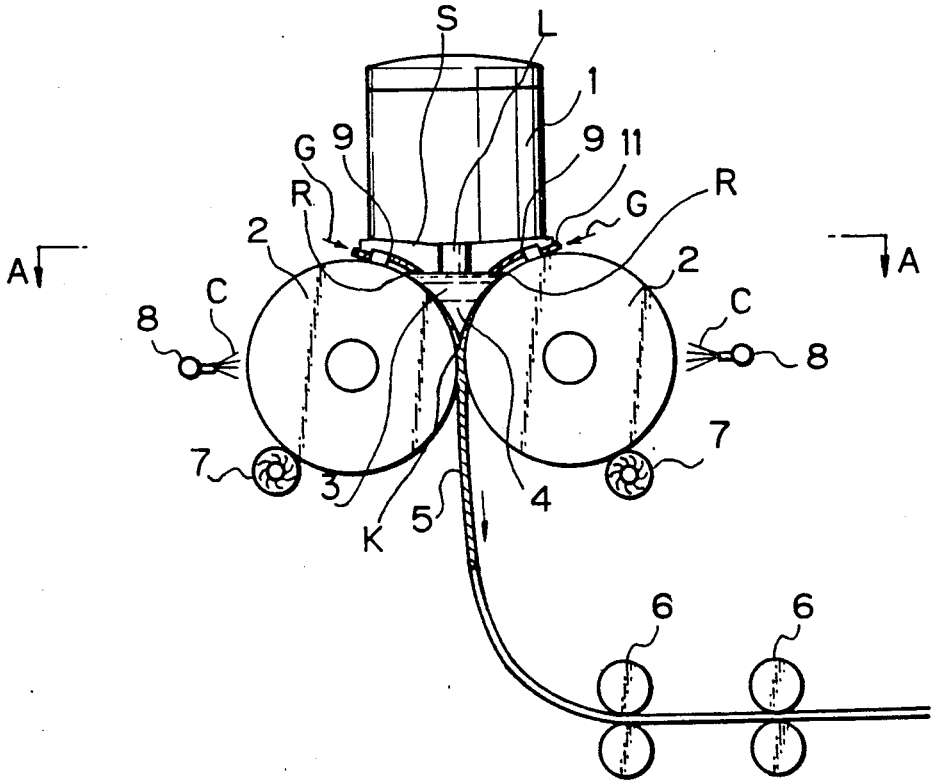
FIG. 1 is a sectional front view showing a twin roll continuous casting machine according to an embodiment of the present invention.
Figure 2:
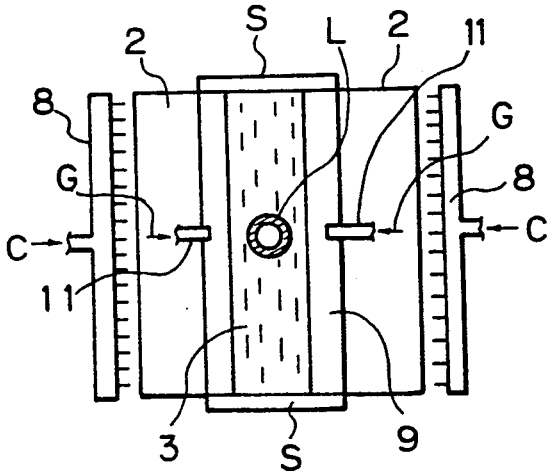
FIG. 2 is a sectional view taken along a line A—A of FIG. 1.
Figure 3:
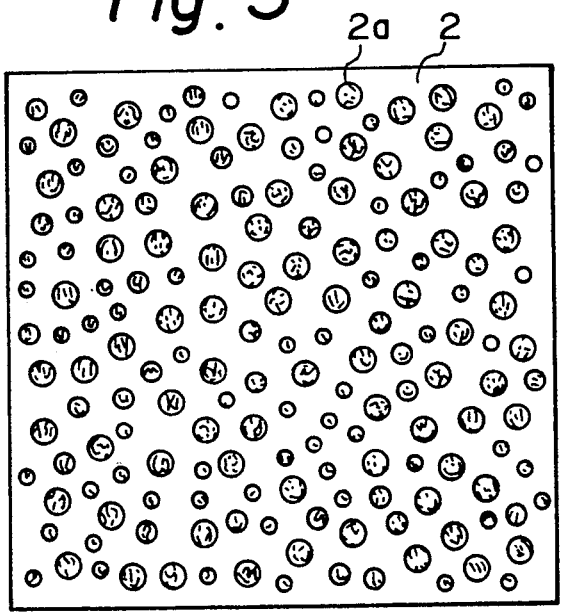
FIG. 3 is a developed plan view showing an example of an arrangement of dimples formed on the surface of a cooling roll.

FIGS. 1 to 3 show a twin roll continuous casting machine for casting steel, according to an embodiment of the present invention. In FIGS. 1 and 2, a tundish 1 supplies molten metal 3 through a nozzle L to a pouring basin 4. The pouring basin 4 is formed by a pair of cooling drums 2 and side walls S; the molten metal 3 solidifies on the surfaces of the cooling drums 2 and moves downward as the cooling drums 2 rotate; two solidified shells of the molten metal 3 are bound together at a kissing point K to form a single cast metal sheet 5; and the cast metal sheet 5 comes out of the cooling drums 2, forms a loop and advances toward pinch rolls 6.

The molten metal 3 first comes into contact with each of the cooling drums 2 in a meniscus area. A gas blowing guide 9 is disposed adjacent to the meniscus area, to supply an inert gas G to the meniscus area. The gas blowing guide 9 extends along the whole width of the corresponding cooling drum 2 between the side walls S, to close the meniscus area and partly cover the surface of the pouring basin 4. Namely, the gas blowing guide 9 forms a closed space adjacent to the meniscus area.

The surface of each of the cooling drums 2 that comes into contact with the molten metal 3 is heat resistive, smooth, and properly hard. In FIG. 3, which is an enlarged view, the surface of the cooling drum 2 has many circular dimples 2*a* each 0.1 to 1.2 millimeters in diameter and 5 to 100 micrometers in depth.

The dimples 2*a* have no corners that may cause surface cracks on a cast metal sheet. The dimples 2*a* may be not only circular but also elliptic; if elliptic, the long and short diameters of an ellipse must be within a range of from 0.1 to 1.2 millimeters.

The inventors found through tests that, if the diameter of each dimple 2*a* is smaller than 0.1 millimeters when casting molten steel, a sufficient slow cooling effect is not provided. In this case, the dimples are difficult to form and may be easily influenced by hit flaws and stains on the drum, but if the diameter of each dimple 2*a* exceeds 1.2 millimeters, the dimples themselves may cause small surface cracks of metal sheets. If the depth of each dimple 2*a* is less than 5 micrometers, a gas gap to be formed has almost no heat insulating effect, and if the depth of each dimple 2*a* exceeds 100 micrometers, a surface crack preventive effect to be achieved by a dimple having 1.2 millimeters or below in diameter is not obtained.

An area ratio of the dimples, i.e., a ratio of a collective flat area of openings of the dimples to a peripheral area of the cooling drum, will be explained in connection with the kinds of gases to be sealed in the dimples and the quality of a cast metal sheet. The area ratio of the dimples controls a heat extracting capacity of the cooling drum.

Figure 4:
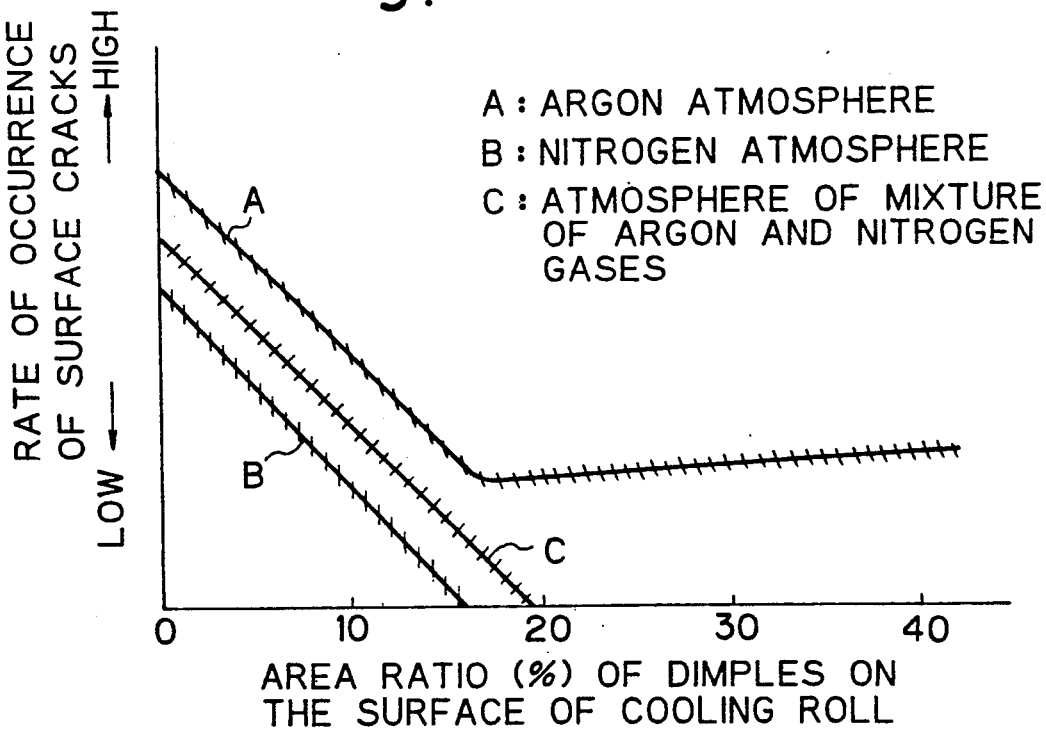
FIG. 4 is a view showing a relationship between the area ratio of dimples on the surface of a cooling roll according to the present invention and a rate of the occurrence of cracks on the surface of a cast metal sheet, for various kinds of gases sealed in the dimples.

FIG. 4 is a view showing a relationship between the area ratio of the dimples and a rate of an occurrence of cracks on the surface of a cast metal sheet, for an argon (Ar) gas as an example of insoluble gases, a nitrogen ($N_2$) gas as an example of soluble gases and a mixture of argon and nitrogen gases (a proportion of the nitrogen gas being 30% in volume or above) as an example of mixed gases. As shown in FIG. 4, the rate of occurrence of small surface cracks is lowered as the area ratio of the dimples is increased. In the case of the insoluble argon (Ar) gas, the rate of occurrence of small surface cracks is large, and cancels the effect of an increased area ratio.

As described before, the argon (Ar) gas does not dissolve in molten metal and expands after receiving heat, thereby preventing the molten metal from entering the dimples. As a result, dents are formed on the surface of a cast metal sheet at locations corresponding to the dimples, and shells formed from the molten metal solidify unevenly, thereby forming small surface cracks on the cast metal sheet.

When the nitrogen ($N_2$) gas or the mixture of gases is caught in the dimples, the rate of occurrence of small surface cracks is lowered as the area ratio of dimples is increased. When the area ratio of dimples exceeds 15% in the case of nitrogen gas or 20% in the case of mixture of gases, the small surface cracks are substantially not formed. Namely, by setting the area ratio of the dimples at about 15% or above, and by sealing a soluble gas or a mixture of gases including a soluble gas in the dimples, it is possible to prevent an occurrence of surface cracks on a cast metal sheet.

As shown in FIG. 1, a cleaning brush 7 is disposed adjacent to each cooling drum 2. The cleaning brush 7 cleans the peripheral surface of the cooling drum 2 and the insides of the dimples 2*a* before they come into contact with molten metal. The cleaned peripheral surface of the cooling drum 2 is coated with a coat material C applied by a roll coater 8. The coat material C mainly contains zircon and alumina, to further improve the quality of a cast metal sheet and prolong the service life of the cooling drum 2.

Next, the inventors cast a metal sheet with use of a continuous casting machine (FIG. 7) having a pair of rotary cooling drums each having dimples as specified above. A soluble gas such as a nitrogen ($N_2$) gas was supplied to molten metal collected in a pouring basin 4. The casting machine of FIG. 7 does not have the gas blowing guide 9 of FIG. 1 but has a sealing chamber 10 for sealing the pouring basin 4 from outside air. The sealing chamber 10 is arranged between a tundish 1 and cooling drums 2. The surface of each of the cooling drums 2 is provided with the dimples at an area ratio of 30%, each being 30 micrometers in depth and 0.5 millimeters in diameter.

With this arrangement, the inventors cast molten austenite stainless steel, and thereafter, the surface conditions of a cast metal sheet were observed. The results of the observation are shown in FIGS. 8(*a*) and 8(*b*).

Figure 8A:
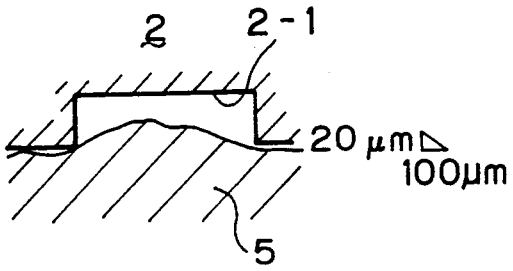
FIGS. 8(*a*) and 8(*b*) are views showing a dimple on the surface of a drum and a transferred profile cast in a nitrogen ($N_2$) gas atmosphere and a microscopic structure of the profile.
Figure 8B:
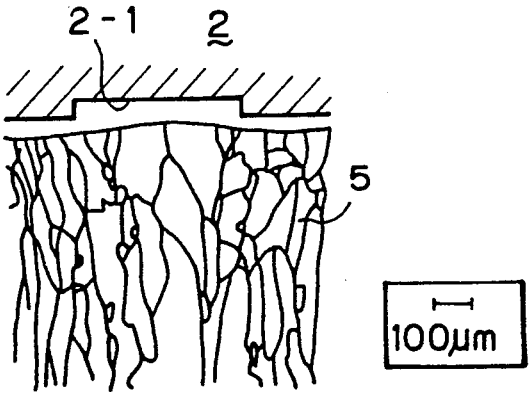

FIG. 8(*a*) is a view showing a dimple transferred profile on the surface of the cast metal sheet during the casting, and FIG. 8(*b*) is a view showing a cross-sectional microscopic structure of the cast metal sheet. As apparent from the figures, a part of the cast metal sheet corresponding to one dimple of the cooling drum protrudes, and a structure at the center of the protrusion is slightly larger than that of a peripheral region.

Figure 9A:
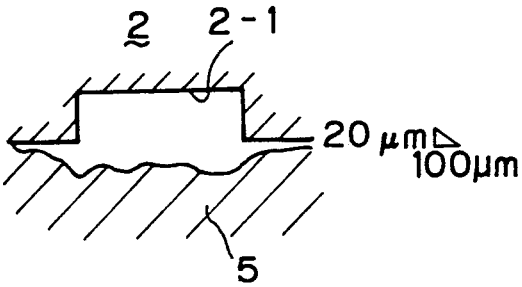
FIGS. 9(*a*) and 9(*b*) are views showing a dimple on the surface of a drum and a transferred profile cast in an argon (Ar) gas atmosphere and a microscopic structure of the profile.
Figure 9B:
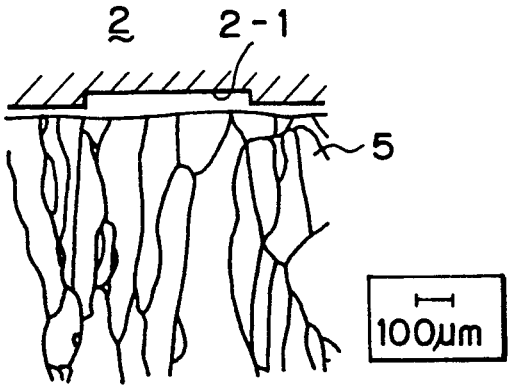

Next, the inventors introduced an insoluble gas such as an argon (Ar) gas into the sealing chamber 10, and cast a metal sheet in a similar manner. FIGS. 9(*a*) and 9(*b*) are views showing the results of the casting. In FIG. 9(*a*), a dimple transferred profile on the surface of the cast metal sheet is dented, unlike FIG. 8(*a*) with the nitrogen ($N_2$) gas. In addition, a part of the cast metal sheet corresponding to one dimple of the cooling drum has a very large structure compared with a peripheral structure.

Consequently, the inventors recognized that, when continuously casting a metal sheet, the dimple transferred profile and structure of the surface of a cast metal sheet differ in accordance with the kind of a sealing gas filled in the sealing chamber.

When casting a metal sheet, a pair of cooling drums having dimples 0.5 millimeters in diameter and 30 micrometers in depth are generally employed, and by changing a revolving speed of the cooling drums, the thickness of the cast metal sheet is adjusted. Accordingly, to prevent an occurrence of surface cracks, a heat extracting performance of the cooling drums must be adjusted in accordance with the thickness of the cast metal sheet. It is not practical, however, to prepare and employ different cooling drums having different dimples (different area ratios, diameters, depths, etc.,) depending on the thickness of a cast metal sheet.

When parts of a solidified shell protrude into respective dimples of the cooling drum, thermal stress acting on the shell is distributed to the protrusions, thereby relaxing a stress that concentrates at a particular location, such as a solidification delayed region, and this may prevent an occurrence of surface cracks. If the protrusions are too large, however, they may cause an uneven brightness on a product made after cold-rolling the cast metal sheet. On the other hand, if the protrusions are too small, or if they are dented, they may provide the slow cooling effect on a solidifying shell, but when the shell contracts, the shell will freely slide on the surface of the cooling drum, and as a result, thermal stress may be concentrated at a weak location, thereby causing large cracks. When excessively deep dents are formed in the surface of a cast metal sheet, a structure at each dent grows excessively as shown in FIG. 9(*b*), to greatly deteriorate the quality of a final product.

Based on the above-mentioned characteristics of atmospheric gases for the casting, the present invention adjusts a mixing ratio of nitrogen ($N_2$) and argon (Ar) gases depending on the thickness of a cast metal sheet or the conditions of irregularities on a solidified shell, thereby easily realizing an optimum surface state on the cast metal sheet. The inventors have confirmed this technical recognition by tests explained below.

By employing the above-mentioned continuous casting machine, molten austenite stainless steel SUS 304 (TYPE 304) is cast to produce sheets 800 millimeters wide and two millimeters and five millimeters thick. Nitrogen ($N_2$) and argon (Ar) gases are mixed at various mixing ratios to form atmospheric gases for the casting. The surface of each cooling drum has dimples 30% in area ratio each 0.5 millimeters in diameter and 30 micrometers in depth.

Figure 10:
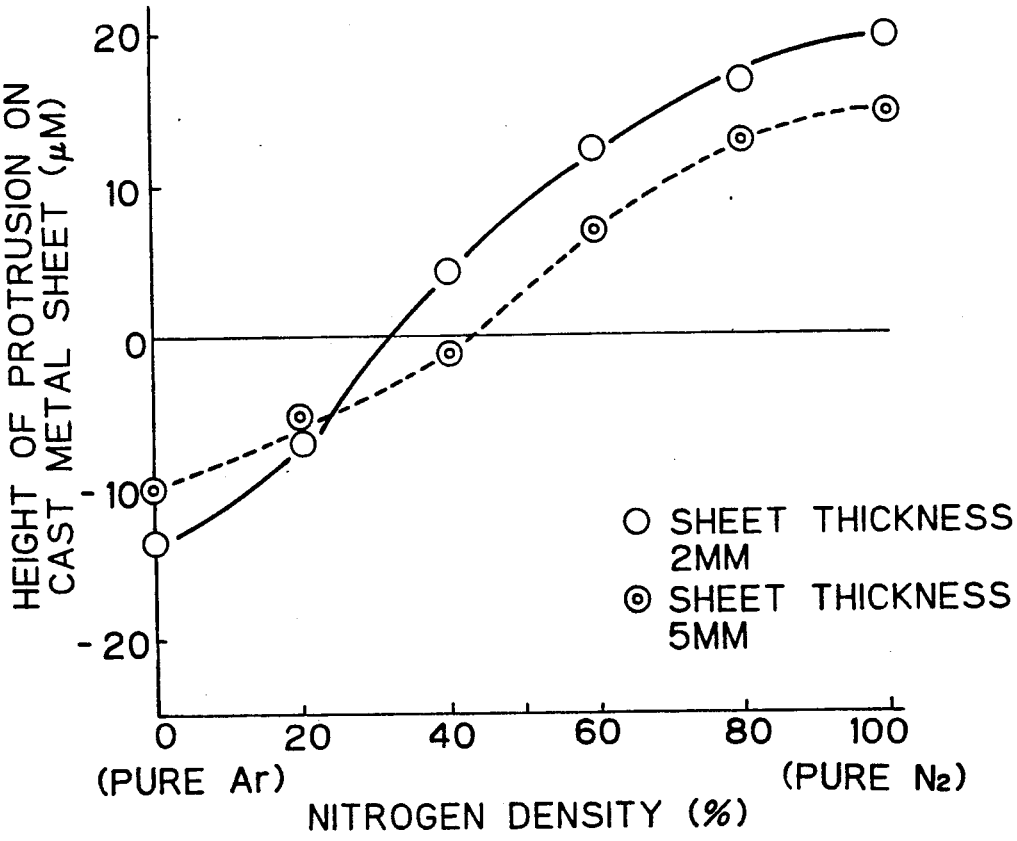
FIG. 10 is a view showing a relationship between a mixing ratio of atmospheric gases and the height of a dimple transferred profile on the surface of a cast metal sheet.
Figure 11:
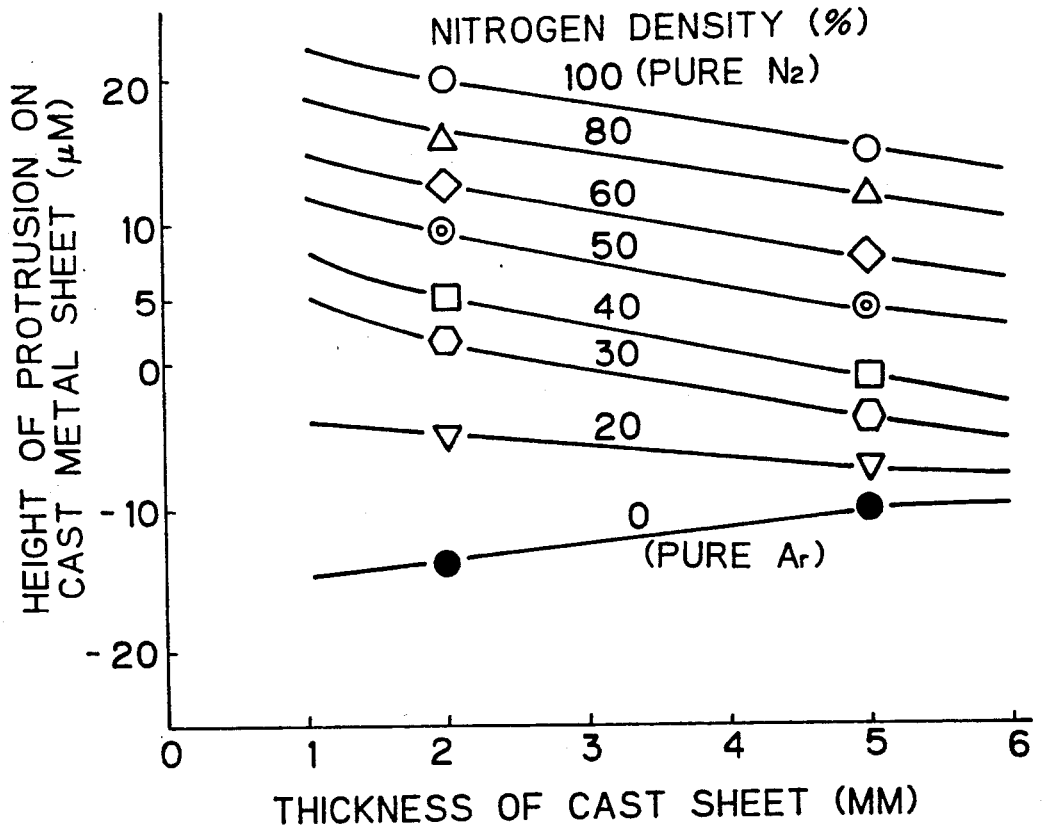
FIG. 11 is a view showing a relationship between the thickness of a cast metal sheet and the height of a protrusion on the surface of a cast metal sheet, for various nitrogen densities.

FIG. 10 is a graph showing a relationship between a dimple transferred profile (the height of an irregularity) of the obtained cast metal sheet and a nitrogen density, for different sheet thicknesses. FIG. 11 is a graph showing a relationship between the dimple transferred profile and a cast sheet thickness, for different nitrogen densities. As apparent from the figures, when the proportion of the soluble gas, i.e., the nitrogen ($N_2$) gas, is increased, the height of a dimple transferred irregularity on the surface of the cast metal sheet is increased. The height (depth) of the irregularity is apparent in the thinner (two millimeters in thickness) sheet than the thicker (five millimeters in thickness) sheet. Surface cracks on cast metal sheets having the dimple transferred profiles of FIG. 10 and the occurrences of uneven brightness after a 50% cold rolling were studied, and the results of the studies are listed in Table 1.

As shown in Table 1, the height of a protrusion on the surface of a cast metal sheet must be about five micrometers or above, to prevent an occurrence of cracks on the cast metal sheet.

To satisfy this requirement for a cast metal sheet two millimeters thick, a gas must include nitrogen ($N_2$) at 40% or more in density, and for a cast metal sheet five millimeters thick, about 50% or more. When the sheet thickness is about one millimeter, the density of nitrogen ($N_2$) must be about 30% or more, preferably from 30% to 90%.

Even if no cracks occur in a cast metal sheet, an uneven brightness after the cold rolling is apparent on the cast metal sheet when the height of each transferred protrusion is about 15 micrometers or more, thereby greatly deteriorating the surface quality of the sheet. To prevent this, the density of nitrogen ($N_2$) must be about 80% or less for casting a metal sheet two millimeters thick. For casting a metal sheet five millimeters thick, the density of nitrogen ($N_2$) can be 100% (pure nitrogen). For a thin sheet about one millimeter thick, the density of nitrogen ($N_2$) must be about 70% or below.

As described above, the present invention properly controls a mixing ratio of soluble gas such as nitrogen ($N_2$) gas and insoluble gas such as argon (Ar) gas depending on the thickness of a cast metal sheet, thereby providing a sheet product having no surface cracks and uniform grains.

The present invention may employ soluble gases such as $N_2$, $H_2$, $CO_2$, CO and $NH_4$ and insoluble gases such as Ar and He.

Next, a method of supplying a sealing gas to a meniscus area whereat the surface of a cooling member starts to come into contact with molten metal will be explained.

Figure 5:
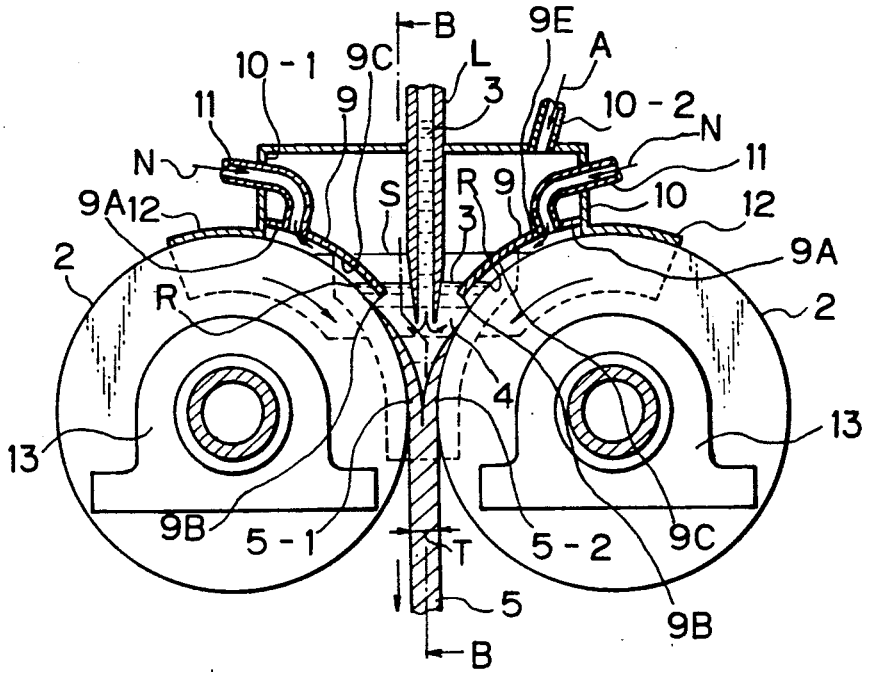
FIG. 5 is a sectional front view showing the essential part of a twin roll continuous casting machine according to another embodiment of the present invention.
Figure 7:
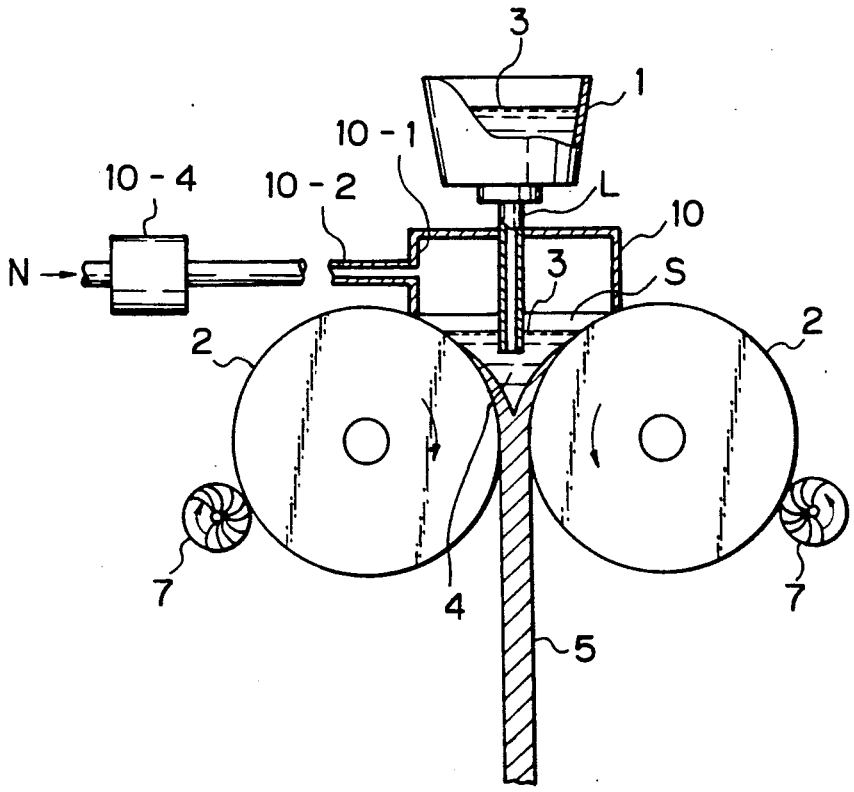
FIG. 7 is a sectional front view showing a twin roll continuous casting machine according to still another embodiment of the present invention.

As described before, the sealing chamber 10 is disposed, and an atmospheric gas is supplied to the sealing chamber 10 (FIG. 7). Another method of supplying the atmospheric gas to the meniscus area is shown in FIG. 11. Further, as shown in FIG. 5, the gas blowing guide 11 may be disposed in the sealing chamber 10 to cover the meniscus area R with a gas. With this arrangement, the gas can sufficiently cover the meniscus area to further improve the effect of the present invention.

The gas supplied to the sealing chamber may be different from the gas supplied through the gas blowing guide. For example, the sealing chamber may be filled with an argon (Ar) gas, and the gas blowing guide can supply a nitrogen ($N_2$) gas. This may prevent the surface of molten metal from being nitrogenized and the argon gas is prevented from entering the meniscus area. This method is effective for a kind of steel that is preferably not nitrogenized.

Figure 6:
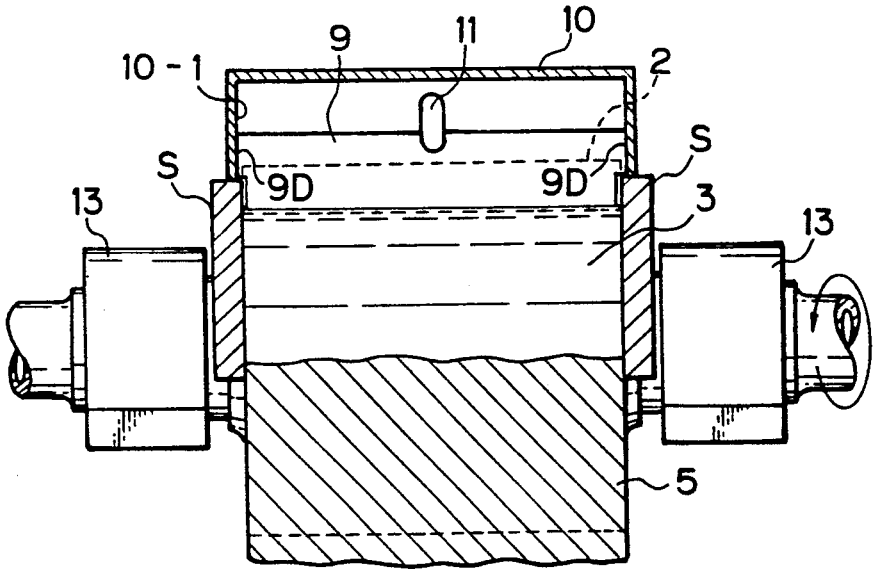
FIG. 6 is a sectional view taken along a line B—B of FIG. 5.

The above embodiment will be explained in more detail with reference to FIGS. 5 and 6.

In the figures, numeral 9 denotes a pair of gas blowing guides. An outer rear end 9A of each of the gas blowing guides 9 is fixed to an inner face of the sealing chamber 10. An inner front end face 9B of the gas blowing guide 9 is dipped in the molten metal 3 or disposed adjacent to the molten metal 3. A lower open face 9C of the gas blowing guide 9 is disposed adjacent to the surface of a cooling drum (cooling member) 2. Upper parts of side faces 9D of the gas blowing guide 9 are fixed to the inner wall of the sealing chamber 10 or disposed adjacent thereto. Lower parts of the side faces 9D of the gas blowing guide 9 are disposed adjacent to inner faces of a pair of side walls S. Numeral 11 denotes a pair of gas supplying pipes each passing through a side face 10-1 of the sealing chamber 10 and being fixed thereto. One end of each of the pipes 11 is connected to a nitrogen ($N_2$) gas supplying apparatus (not shown), and the other end of the pipe 11 is fixed to an outer rear end 9E of corresponding gas blowing guide 9 and open to a gap between the gas blowing guide 9 and the cooling drum 2, thereby supplying a gas from the nitrogen gas supplying apparatus (not shown) to the inside of the gas supplying guide 9.

Between lower end faces of the sealing chamber 10 and upper end faces of the side walls S, heat resistive sealing materials are inserted, and the sealing chamber 10 and side walls S are supported by a frame (not shown). Each of the gas blowing guides 9 forms a separate closed space in the sealing chamber 10 adjacent to the meniscus area.

This embodiment continuously casts a thin hoop 5. A gas supplying pipe 10-2 supplies, for example, an argon (Ar) gas A to the sealing chamber 10 to fill the chamber with the gas. The cooling drums 2 are rotated to supply the molten metal 3 from a dipped nozzle L to the pouring basin 4. The gas supplying pipe 11 supplies a nitrogen ($N_2$) gas N to the gap between the gas blowing guide 9 and the peripheral face of the cooling drum 2. A pressure of the supplied nitrogen gas N is substantially equal to or slightly higher than that of the argon gas A. The nitrogen gas N seals the surface of the molten metal 3. The molten metal 3 is cooled by the cooling drums 2 and solidified to form shells 5-1 and 5-2 that are drawn downward.

Meanwhile, a large part of the surface of the molten metal 3 in the pouring basin 4 is sealed by the argon gas A that is insoluble in the molten metal 3, so that the molten metal 3 is substantially not in contact with the nitrogen gas N. Accordingly, a density of dissolved gas in the molten metal 3 is not substantially increased, so that the gas does not influence the quality of a cast metal sheet.

Even with the sealing chamber 10 and gas blowing guides 9 arranged on the pouring basin 4, air may penetrate gaps between the sealing chamber 10 and the surfaces of the cooling drums 2 and enter the pouring basin 4.

According to the inventors' studies on the air penetration into the pouring basin and the rotation of the cooling drums, it was found that the dimples formed on the surface of each cooling drum catch air and an air layer several micrometers thick is formed on the surface of the cooling drum. When the cooling drum revolves at a rotation speed of 20 to 100 meters per minute, an air layer of about 10 to 50 micrometers is formed on the surface of the cooling drum. The air layer and the air caught in the dimples penetrate the sealing chamber.

To block the penetration of air, it is effective to blow an inert gas directly to the surface of each cooling drum just before the cooling drum moves in the sealing chamber.

This embodiment will be explained with reference to FIGS. 12 and 13.

In the figures, each side wall 10-1 of a sealing chamber 10 extends along the width of a cooling drum 2. On an outer surface of the side wall 10-1, a box-type slit nozzle 14 extends along the width of the cooling drum 2 and opens toward the surface of the cooling drum. The nozzle 14 comprises a gas container 16 having an inert gas supplying pipe 17, and a nozzle portion 15 for blowing a gas.

A pouring basin 4 is kept in a non-oxidizing atmosphere within the sealing chamber 10 disposed above the pouring basin 4. The box-type slit nozzle 14 arranged on the outer face of the side wall 10-1 of the sealing chamber 10 blows an inert gas (preferably a mixture of a gas soluble in molten metal and a gas insoluble in the molten metal) to blow off an air film formed on the surface of the cooling drum 2 as well as air caught in dimples (not shown) of the cooling drum, thereby preventing the air from entering the sealing chamber 10. This completely maintains the non-oxidizing atmosphere in the sealing chamber 10.

In this way, the air attaching to the surface of each cooling drum is completely blocked just before the sealing chamber, so that the molten metal is not oxidized or disturbed at an initial solidifying position, and a metal sheet is stably cast.

Unlike a conventional sealing chamber system, the system of the present invention can remarkably reduce an amount of oxides (scum) produced on the surface of molten metal and equalize solidification of the molten metal. The present invention can reduce cracks caused by the scums in the molten metal to about one tenth, from 0.10 $m/m^2$ to 0.01 to 0.02 $m/m^2$. The present invention blows the inert gas onto the surface of each cooling drum substantially at a right angle, and this angle is most effective. Naturally, the blowing of the gas can be inclined in a rotating direction of the cooling drum or in a reverse direction within a range at which a proper effect of the present invention is obtained.

To evenly blow the gas, the box-type slit nozzle may be partitioned. It is also possible to employ a slit nozzle having a circular cross section, a circular nozzle, or a nozzle having an optional shape.

The side wall of the sealing chamber and the nozzle may be formed integrally.

Another embodiment for blocking air from entering the sealing chamber will be explained with reference to FIG. 14.

Figure 14:
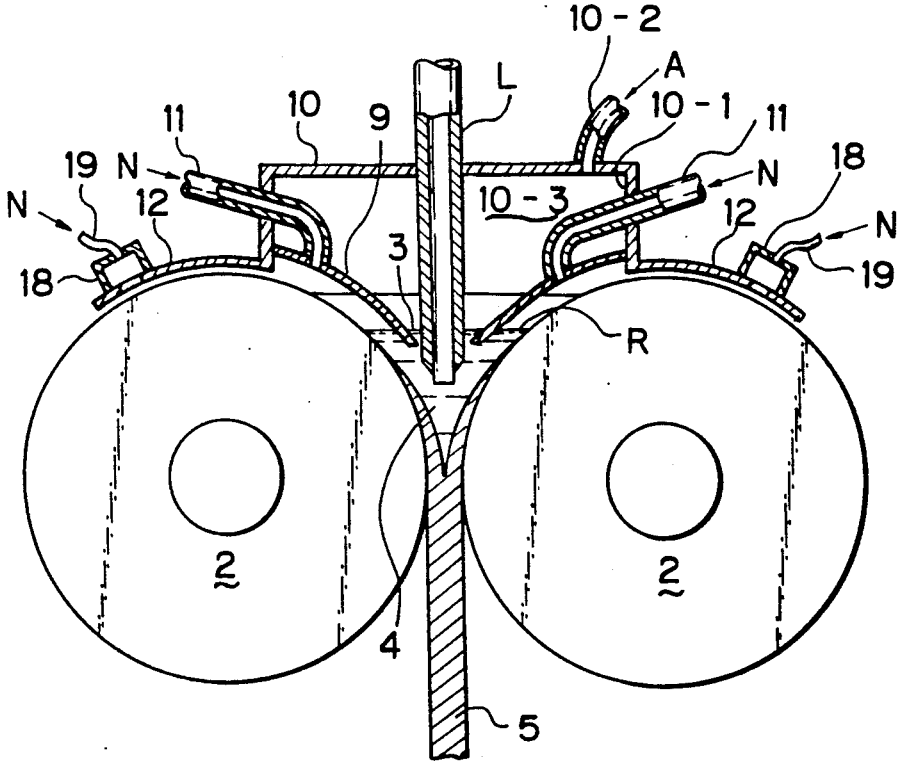
FIG. 14 is a partly sectioned front view showing the essential part of a modification of the embodiment of FIG. 12.

The embodiment of FIG. 14 is similar to that of FIG. 5. An interior 10-3 of a sealing chamber 10 is filled with a gas (an argon gas) that is insoluble in molten metal. A gas (a nitrogen gas) is supplied to a meniscus area R. An external cover 12 is fixed to a lower end of a side wall 10-1 of the sealing chamber 10 and positioned adjacent to the surface of each cooling drum 2. A box-type slit nozzle 18 is arranged at an end of the external cover 12. A gas supplying pipe 19 supplies a nitrogen ($N_2$) gas to blow off an air film on the surface of the cooling drum 2. Since the inside of the external cover 12 is filled with the nitrogen gas, the air is more effectively blocked from entering the sealing chamber 10.

Figure 12:
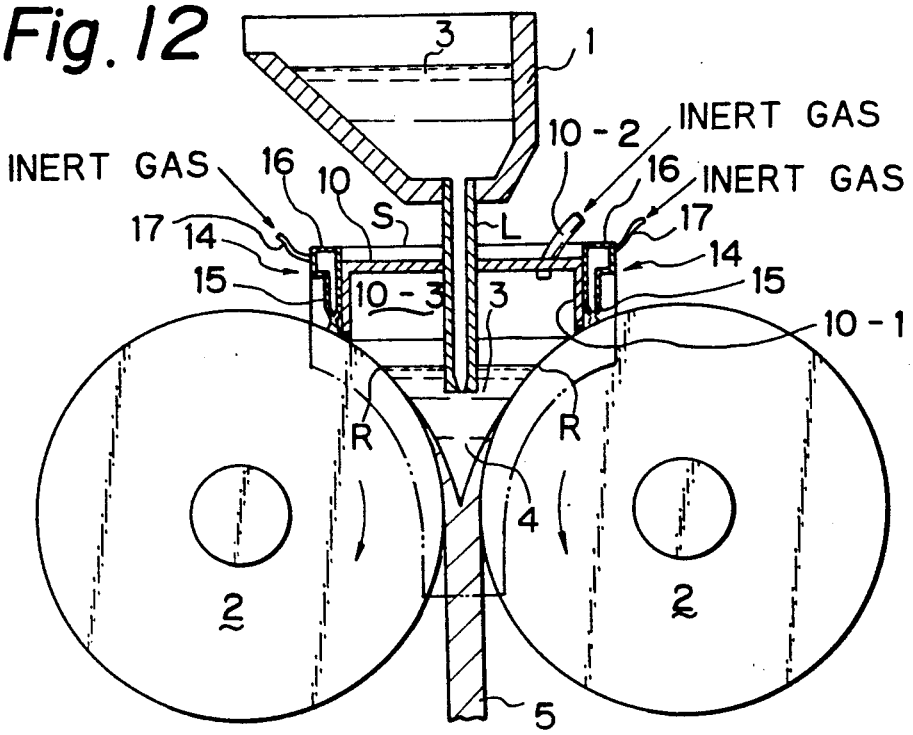
FIG. 12 is a sectional front view showing a twin roll continuous casting machine according to still another embodiment of the present invention.
Figure 13:
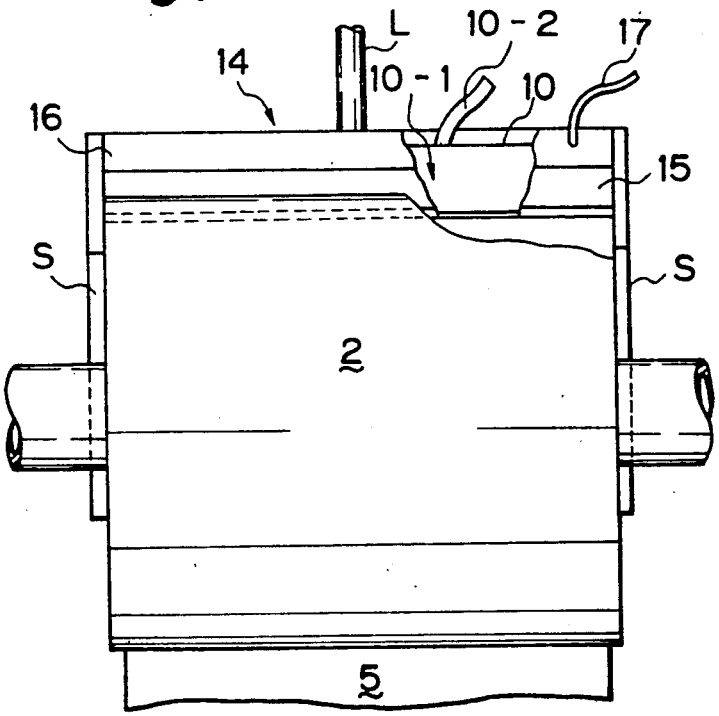
FIG. 13 is a partly broken side view of the embodiment of FIG. 12.

The external cover 12 may be installed to the apparatus of FIG. 12. The gas supplying pipe 19 may supply the nitrogen ($N_2$) gas or a mixture of nitrogen and argon gases, etc., optionally selected among inert gases.

A technique of adjusting an atmosphere around a meniscus area has been explained above. The inventors have found that the temperature of an atmosphere in a sealing chamber influences a cast metal sheet.

When an inert gas is employed as a casting atmosphere as in the case of the present invention, the inert gas removes heat from the surface of molten metal collected in a pouring basin, thereby forming a very thin solidified film on the surface of the molten metal. In addition, a gas caught in each dimple on the surface of a cooling drum rapidly expands when the gas touches with the molten metal and forms an uneven gas cap or a dent on a solidified shell of the molten metal.

To deal with this problem, the present invention preheats the inert gas to 500 degrees in centigrade or above to expand the gas in advance. Thereafter, the gas is supplied to the sealing chamber or to a gas blowing guide.

The inert gas preheating technique is quite effective for casting thin sheets at a low temperature.

When continuously casting a thin metal sheet, an overheat temperature of molten metal is made as low as possible, to prevent an occurrence of surface cracks on the metal sheet due to cooling. When an inert gas is continuously introduced to a sealing chamber to adjust a casting atmosphere of the molten metal, the gas takes heat away from the molten metal. At this time, a very thin solidified film 100 micrometers or thinner is locally formed on the surface of the molten metal collected in a pouring basin, particularly in a meniscus area adjacent to a cooling drum, which pulls, the solidified film. Accordingly, while the cast metal sheet is being cooled and shaped, island-like abnormal structures having different growing orientations are formed on the surface of the cast metal sheet. When the cast metal sheet with the abnormal structures is cooled and rolled to provide a product, the surface quality of the product is drastically degraded due to surface defects such as uneven brightness.

To deal with this problem, the present invention heats the inert gas to a temperature of 500 degrees in centigrade or above in carrying out a low temperature casting with an overheat temperature of molten metal of, for example, 10 degrees centigrade. An apparatus for realizing such preheating is indicated with a reference numeral 10-4 in FIG. 7. In the figure, molten metal 3 in a pouring basin 4 is kept at an overheat temperature of 10 degrees centigrade just before a solidifying temperature of the molten metal, so that the surface of the molten metal may be easily solidified due to a heat removing effect of an atmospheric gas.

Figure 15:
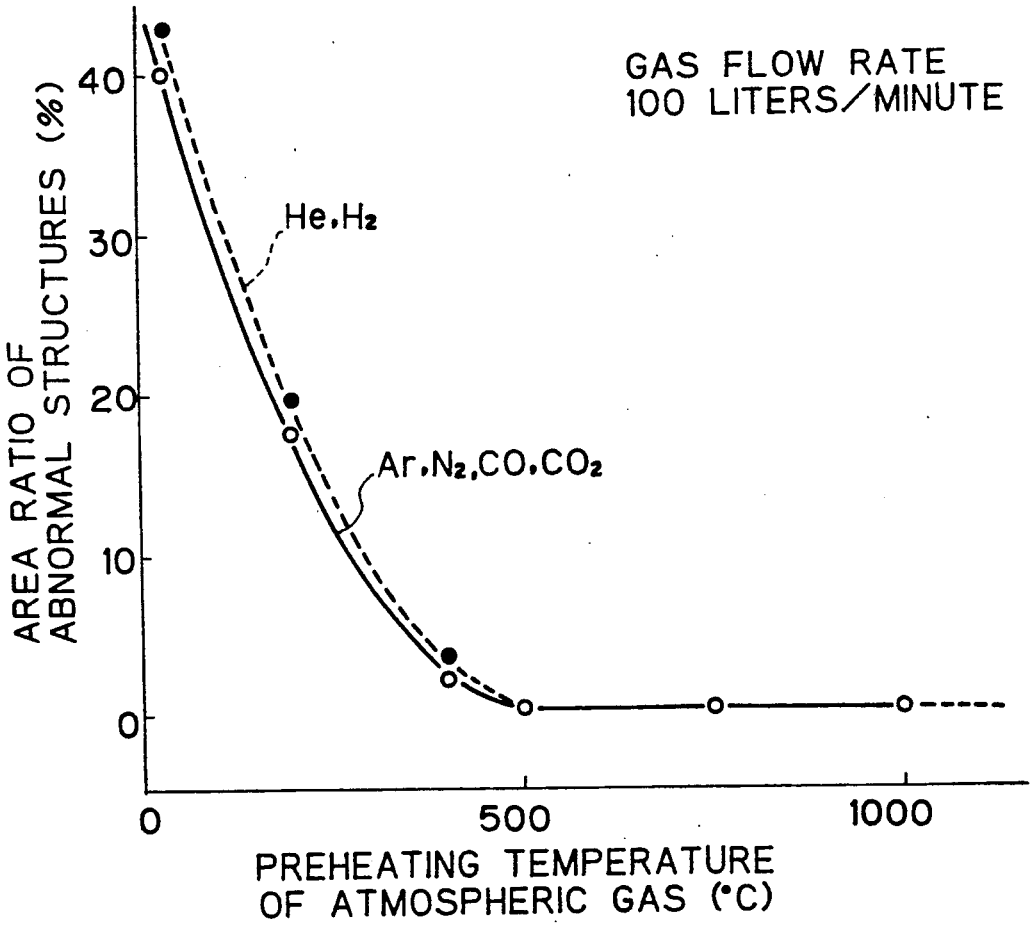
FIG. 15 is a view showing a relationship between a preheating temperature of an atmospheric gas and a rate of occurrence of abnormal structure.

The present invention, however, preheats the atmospheric gas by the gas preheater 10-4 to prevent the gas from removing heat from the molten metal, thereby preventing a formation of a solidified film on the molten metal if the gas is not preheated. FIG. 15 is a view showing a relation of atmospheric gas preheating temperature (degrees in centigrade) to an area ratio (%) of abnormal structures produced on a cast metal sheet, for various non-oxidizing atmospheric gases. In the figure, white circles represent gases of Ar, $N_2$, CO and $CO_2$, and black circles represent gases of He and $H_2$. As is apparent in FIG. 15, regardless of the kind of an atmospheric gas, no abnormal structures are produced on the cast metal sheet if the atmospheric gas is preheated to 500 degrees centigrade or above. An upper limit of the preheating temperature is not particularly specified. It is not necessary, however, to preheat the atmospheric gas over a melting point of molten metal.

Therefore, the present invention preheats a non-oxidizing atmospheric gas to a temperature exceeding 500 degrees in centigrade and below a melting point of molten metal.

FIG. 15 was plotted for an austenite stainless steel SUS 304 (TYPE 304). The temperature of the molten metal in the pouring basin was 1465 degrees in centigrade, and a flow rate of the gas was 100 liters per minute.

With the above method, molten metal just before solidification does not produce a solidified film, and by rapidly cooling the molten metal with cooling drums, a uniform and strong solidified shell may be produced. Accordingly, a thin metal sheet having no abnormal structures and cracks and an excellent surface quality can be cast.

EXAMPLES

Molten austenite stainless steel produced by a normal method was cast by a twin drum continuous casting machine to form metal sheets 800 millimeters in width at a casting speed of 80 meters per minute. Table 1 shows casting conditions, the surface states of the cast sheets and brightness unevenness states after 50% cold rolling, of cast numbers 1 to 13.

The meanings of the marks in an overall evaluation column of the table are as follows:

Double circle: No surface cracks and no brightness unevenness are observed after cold rolling. The surface quality after the cold rolling is acceptable.

Single circle: No surface cracks but brightness unevenness are observed after cold rolling. The cast sheet is acceptable depending on usage. (For example, usable after polishing.)

Triangle: Small surface cracks and slight brightness unevenness are observed. The cast sheet is acceptable depending on usage. (For example, usable after polishing.)

X: Large surface cracks are observed and the cast sheet is not acceptable.

Cast numbers 12 and 13 were produced by preheating a supply gas to 750 degrees centigrade, and therefore, no abnormal structures occur on the surfaces of the cast metal sheets. It was possible to cast these metal sheets from molten metal having a low temperature of 1465 degrees in centigrade.

As described above, the present invention can prevent an occurrence of surface cracks. (Even if surface cracks occur, they are so small that they may be eliminated by polishing, thereby providing a smooth surface.) In addition, the present invention can eliminate surface gloss unevenness, thereby remarkably improving the surface quality of a cast product.

TABLE 1

| Classification | | Casting No. | Casting Apparatus | Thickness of Cast Sheet (mm) | Dimple on Drum Surface: Diameter (mm) | Dimple on Drum Surface: Depth (μm) | Dimple on Drum Surface: Area Ratio (%) | Supply of Atmospheric Gas: Pouring Basin | Supply of Atmospheric Gas: Contact Starting Area |
|---|---|---|---|---|---|---|---|---|---|
| Sample of invention | E1 | 1 | FIG. 1 | 2 | 0.5 | 30 | 30 | x | ○ |
| | E2 | 2 | FIG. 5 | 2 | 0.5 | 30 | 30 | ○ | ○ |
| Comparison | 1 | 3 | FIG. 1 | 2 | 0.5 | 30 | 30 | x | ○ |
| Samples of Invention | E3 Ⓐ | 4 | FIG. 7 | 2 | 0.5 | 30 | 30 | | ○ (Common) |
| | E3 Ⓑ | 5 | FIG. 7 | 2 | 0.5 | 30 | 30 | | ○ (Common) |
| | E3 Ⓒ | 6 | FIG. 7 | 2 | 0.5 | 30 | 30 | | ○ |

TABLE 1-continued

| | | | | | | | | | |
|---|---|---|---|---|---|---|---|---|---|
| | | | | | | | | | (Common) |
| | E3 Ⓓ | 7 | FIG. 5 | 2 | 0.5 | 30 | 30 | ○ | ○ |
| | E4 Ⓔ | 8 | FIG. 7 | 5 | 0.5 | 30 | 30 | | ○ (Common) |
| | E4 Ⓕ | 9 | FIG. 7 | 5 | 0.5 | 30 | 30 | | ○ (Common) |
| Comparison | 2 | 10 | FIG. 7 | 5 | 0.5 | 30 | 30 | | ○ (Common) |
| Samples of Invention | E4 Ⓖ | 11 | FIG. 7 | 5 | 0.5 | 30 | 30 | | ○ (Common) |
| | E5 Ⓗ | 12 | FIG. 7 | 2 | 0.5 | 30 | 30 | | ○ (Common) |
| | E5 Ⓘ | 13 | FIG. 7 | 2 | 0.5 | 30 | 30 | | ○ (Common) |

| | | Kind of Atmospheric Gas | | | Quality Evaluation of Sheet Surface | | | |
|---|---|---|---|---|---|---|---|---|
| | | | | | Cast Sheet | | | |
| Classification | | Pouring Basin | Contact Starting Area | Pre-heating temperature of gas (°C.) | Surface cracks ($m/m^2$) | Height of Transferred Profile (μm) | Uneven Brightness After Cold Rolling | Total Evaluation |
| Sample of invention | E1 | Outside air | $N_2$ | Room temperature | None | 20 | Many | ○ |
| | E2 | Ar | $N_2$ | Room temperature | None | 20 | Many | ○ |
| Comparison | 1 | Outside air | Ar | Room temperature | 1.5 | −13 | Slight | x |
| Samples of Invention | E3 Ⓐ | $N_2$ Ar | 50 30 | Room temperature | None | 7 | None | ◎ |
| | E3 Ⓑ | $N_2$ Ar | 70 30 | Room temperature | None | 10 | None | ◎ |
| | E3 Ⓒ | $N_2$ Ar | 30 70 | Room temperature | 0.05 | −5 | Slight | Δ |
| | E3 Ⓓ | $N_2$ | $N_2$ | Room temperature | None | 20 | Many | ○ |
| | E4 Ⓔ | $N_2$ Ar | 80 20 | Room temperature | None | 13 | None | ◎ |
| | E4 Ⓕ | $N_2$ | 100 | Room temperature | None | 15 | Many | ○ |
| Comparison | 2 | Ar | 100 | Room temperature | 1.5 | −14 | Slight | x |
| Samples of Invention | E4 Ⓖ | $N_2$ Ar | 30 70 | Room temperature | 0.04 | −5 | Slight | Δ |
| | E5 Ⓗ | $N_2$ Ar | 50 50 | 750 | None | 8 | None | ◎*1 |
| | E5 Ⓘ | $N_2$ Ar | 70 30 | 750 | None | 11 | None | ◎*2 |

*1Temperature of molten metal: 1465° C. No abnormal structure
*2Temperature of molten metal: 1465° C. No abnormal structure

We claim:

1. A method of continuously casting a metal sheet by supplying molten metal between movable cooling members, comprising the step of supplying a soluble gas to areas whereat surfaces of said cooling members having dimples start to come into contact with said molten metal, wherein said gas comprises soluble gas in a volumetric ratio of at least 30% to 90%.

2. A method as set forth in claim 1, wherein insoluble gas is mixed with said soluble gas and said gases are supplied to said contact starting areas.

3. A method as set forth in claim 1, wherein said soluble gas is supplied to said contact starting areas surrounded by a non-oxidizing atmospheric gas.

4. A method as set forth in claim 2, wherein said mixture of soluble and insoluble gases is supplied to said contact starting areas surrounded by a non-oxidizing atmospheric gas.

5. A method as set forth in claim 2, wherein said mixture of soluble and insoluble gases is supplied to a pouring basin defined between said cooling members and closed to an outside air.

6. A method as set forth in claim 1, wherein said soluble gas is at least one gas selected from a group consisting of $N_2$, $H_2$, $CO_2$, CO, and $NH_4$.

7. A method as set forth in claim 2, 4 or 5, wherein said insoluble gas is at least one gas selected from a group consisting of Ar and He.

8. A method as set forth in claim 1, wherein each of said dimples formed on the surface of each of said cooling members is circular or elliptic and has an opening 0.1 to 1.2 millimeters in diameter and 5 to 100 micrometers in depth.

9. A method as set forth in claim 1, wherein a gas blowing guide is disposed above the surface of each of said cooling members at said pouring basin to supply said gas to said contact starting areas.

10. A method as set forth in claim 1, wherein said soluble gas is preheated, expanded and then supplied.

11. A method as set forth in claim 10, wherein said mixture of gases is heated to a temperature of 500 degrees centigrade or above, and in an atmosphere of said heated mixture of gases, molten metal having a overheat temperature of 10 degrees centigrade or below is supplied to and cast by said cooling members.

12. A method as set forth in claim 5, wherein, just before the surfaces of said cooling members are moved to outside air closed areas of said pouring basin, an inert gas is blown onto the surface of each of said cooling members.

13. A method as set forth in claim 5, wherein an external cover is disposed in front of each outside air closed area of said pouring basin, and an inert gas is blown to the surface of said cooling members at said external cover.

14. A method as set forth in claim 2, wherein said soluble gas is at least one kind of gas selected from a group of gases consisting of $N_2$, $H_2$, $CO_2$, CO, and $NH_4$.

15. A method as set forth in claim 1, wherein an area ratio of said dimples on the surface of each of said cooling members is 15% or above.

16. A method as set forth in claim 2, wherein a gas blowing guide is disposed above the surface of each of said cooling members at said pouring basin to supply said gas to said contact starting areas.

17. A method as set forth in claim 2, wherein said mixture of soluble and insoluble gases is preheated, expanded, and then supplied.

18. A method as set forth in claim 2, wherein an area ratio of said dimples on the surface of each of said cooling members is 20% or above.

* * * * *